US005620046A

United States Patent [19]

Waldhelm et al.

[11] Patent Number: 5,620,046

[45] Date of Patent: Apr. 15, 1997

[54] HEAT EXCHANGER, PARTICULARLY A REFRIGERANT EVAPORATOR

[75] Inventors: Thorsten Waldhelm; Christoph Walter, both of Stuttgart, Germany

[73] Assignee: Behr GmbH & Co., Stuttgart, Germany

[21] Appl. No.: 372,364

[22] Filed: Jan. 13, 1995

[30] Foreign Application Priority Data

Jan. 13, 1994 [DE] Germany ..... 9400502 U

[51] Int. Cl.[6] ..... F28D 1/02

[52] U.S. Cl. ..... 165/153; 165/176; 165/167; 62/515

[58] Field of Search ..... 165/153, 167, 165/176; 62/515

[56] References Cited

U.S. PATENT DOCUMENTS

| | | | |
|---|---|---|---|
| 4,327,802 | 5/1982 | Beldam | 165/153 |
| 4,815,532 | 3/1989 | Sasaki et al. | 165/153 X |
| 4,915,163 | 4/1990 | Matsunaga et al. | 165/153 |
| 4,969,512 | 11/1990 | Aoki et al. | 165/153 |
| 5,042,577 | 8/1991 | Suzumura | 165/153 |
| 5,111,877 | 5/1992 | Buchanan et al. | 165/153 |
| 5,125,453 | 6/1992 | Bertrand et al. | 165/153 |
| 5,137,082 | 8/1992 | Shimoya et al. | 165/110 |
| 5,176,206 | 1/1993 | Nagasaka et al. | 165/153 |
| 5,358,034 | 10/1994 | Nishishita et al. | 165/153 |
| 5,417,280 | 5/1995 | Hayashi et al. | 165/153 |

FOREIGN PATENT DOCUMENTS

| | | | |
|---|---|---|---|
| 0049994 | 3/1986 | Japan | 165/153 |
| 0187097 | 8/1988 | Japan | 165/167 |
| 0106697 | 4/1990 | Japan | 165/153 |
| 0186194 | 8/1991 | Japan | 165/153 |
| 0221789 | 9/1991 | Japan | 165/153 |

*Primary Examiner*—John Rivell
*Assistant Examiner*—Christopher Atkinson
*Attorney, Agent, or Firm*—Evenson, McKeown, Edwards & Lenahan, P.L.L.C.

[57] ABSTRACT

A heat exchanger, particularly a refrigerant evaporator, is disclosed which comprises a soldered block of stamped plates which, in pairs, form a U-shaped guide and collecting ducts for a heat exchange medium. Corrugated ribs are arranged between the plate pairs, and plate-shaped lateral parts are arranged on the front ends of the block with the insertion of corrugated ribs. It is provided that, in the area of the collecting ducts, the lateral parts are provided with at least one profiling which, together with a covering sheet closing off the last plate, forms a chamber which has a connection to at least one of the collecting ducts.

7 Claims, 2 Drawing Sheets

HEAT EXCHANGER, PARTICULARLY A REFRIGERANT EVAPORATOR

BACKGROUND AND SUMMARY OF THE INVENTION

This invention relates to a heat exchanger, particularly a refrigerant evaporator, comprising a soldered block of stamped plates which, in pairs, form a U-shaped guide and collecting ducts for a heat exchange medium, comprising corrugated ribs arranged between the plate pairs, and comprising plate-shaped lateral parts arranged on the front ends of the block with the insertion of corrugated ribs.

In the case of heat exchangers of this type, connections must additionally be provided for a feeding pipe and a draining pipe for refrigerants. For this purpose, it is known (U.S. Pat. No. 5,137,082) to insert a flattened pipe piece between a stamping of the last plate, which pertains to the collecting duct, and a lateral part.

It is also known (U.S. Pat. No. 5,125,453) to insert special connecting elements between two plate pairs, which connecting elements are also designed in a plate shape.

Furthermore, it is known (U.S. Pat. No. 5,176,206) to provide two of the plate pairs with a special stamped shape in the area of the collecting ducts, which, together, form one connection respectively.

It is an object of the invention to improve a heat exchanger of the initially mentioned type with respect to manufacturing techniques.

This object is achieved in that the lateral parts are provided in the area of the collecting ducts with a stamped profiling which, together with a cover sheet closing off the last plate, forms a chamber which has a connection to at least one of the collecting ducts.

A chamber of this type can be integrated into the lateral parts in a simple manner without the requirement of additional components. As previously, before the soldering, the lateral part can in a known manner be joined with the plates and the corrugated ribs to form a block which is then soldered as a whole in a furnace. The chamber formed in this manner may be used, for example, as a deflection between two or several collecting ducts. Furthermore, it is possible to provide the profiling with a receiving opening for a connection piece so that connections are created for a feeding pipe or a draining pipe without the use of additional components, that is, are integrated into one or both lateral parts.

Other objects, advantages and novel features of the present invention will become apparent from the following detailed description of the invention when considered in conjunction with the accompanying drawings.

DETAILED DESCRIPTION OF THE DRAWINGS

Figure 1:
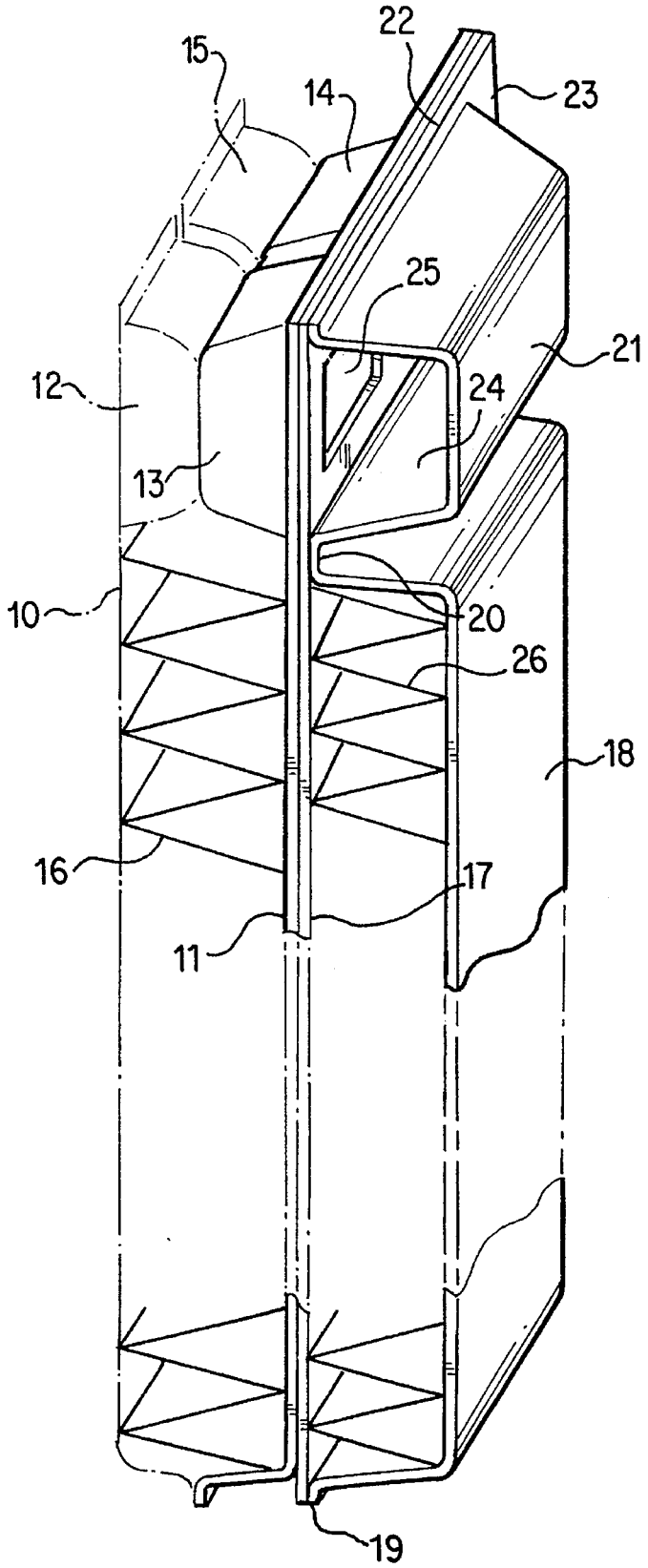
FIG. 1 is a perspective view of the area of a front end of a heat exchanger according to the invention comprising a lateral part which forms a connection for a feeding or draining pipe.

The heat exchanger, particularly a so-called plate evaporator for an air-conditioning system of a motor vehicle, which is shown only partially in FIG. 1, has a plurality of stamped plates 10, 11. These successive plates 10, 11, which each follow one another in a mirror-inverted manner, are connected with one another also in a successive manner. The plates 10, 11, which are stamped from sheets, particularly sheets made of an aluminum alloy, are designed in a known manner such that one pair of plates 10, 11 respectively forms a U-shaped guide for a refrigerant, the legs of the U-shaped guide ending in the collecting ducts. The plate 10 illustrated by an interrupted line forms, together with the preceding plate which is not shown and corresponds to plate 11, this U-shaped guide between surrounding adjoining edges, for the purpose of which, the plates are provided with stampings in a manner which is not shown in detail but is known from prior art, which stampings have only a relatively low depth. In the area of their upper ends, the plates 10, 11 are provided with deeper stampings 12, 13, 14, 15 which have a larger stamping depth and which adjoin with their outer surfaces. These stampings 12 to 15 have through holes so that, by means of the through holes, these stampings 12 to 15 form collecting ducts for the heat exchange medium. Between the plates 10, 11, corrugated ribs 16 are arranged which are also formed from a sheet consisting preferably of an aluminum alloy. To this extent, the heat exchanger corresponds to the construction known from prior art so that reference can be made to the prior art concerning further details.

The plate 11 situated on the outer front end is covered by means of a flat covering sheet 17. This covering sheet 17 closes off the stampings 13, 14 surrounded by plane surfaces. The covering sheet 17 is followed by a lateral part 18 which is also formed from a sheet of an aluminum alloy. The lateral part 18 has an essentially U-shaped form and corresponds in its width to the width of the plates 10, 11 and of the covering sheet 17. It is supported on the covering sheet 17 by means of a lower flange 19 and an upper flange 20. In the area between the flanges 19, 20, a corrugated rib 26 is arranged which connects the covering sheet 17 with the lateral part 18. The lower flange 19 may be eliminated because the support by means of the corrugated rib 26 is sufficient.

In the area of the collecting ducts, that is, of the stampings 12 to 15, the lateral part is provided with a stamped profile 21. On three sides, the stamped profile 21 is surrounded by an edge, specifically by the flange 20 and the edges 22, 23, by means of which it rests against the covering sheet 17. On the remaining face, the stamped profile 21 is open and therefore, together with the covering sheet 17, forms a connection opening 24 for a connection piece of a feeding or draining pipe. The chamber which is formed by the stamping 21 and the covering sheet 17 and which has the connection opening 24 is connected by way of an opening 25 of the covering sheet 17 with the collecting duct formed by the stampings 12, 13. In a simple manner, this chamber may therefore be utilized as a connection for this collecting duct.

Correspondingly, the opposite front end of the heat exchanger is provided on the then last plate 10 with a covering sheet and a lateral part which also has a profiling corresponding to profiling 21, while the covering sheet is then provided with an opening which connects the collecting duct formed by the stampings 14, 15 with this chamber. If partitions are installed in the chamber between the covering sheet 17 and the lateral part 18, other flow courses may also be provided.

The construction method according to the invention has the advantage that a connection or at least a connection opening 24 is integrated in the block assembled from the plates 10, 11, the corrugated ribs 16, the covering plate 17 and the lateral part 18 as well as from the corrugated rib 26 situated between the covering sheet 17 and the lateral part 18, which block is held in this manner by means of a suitable gripping device. The thus formed block will then be soldered in the surface. For this purpose, it is expediently provided that the plates 10, 11, the covering sheet 17 and the lateral part 18 as well as the opposite elements are solder plated, as well as possibly also the corrugated ribs 16, 26.

Figure 2:
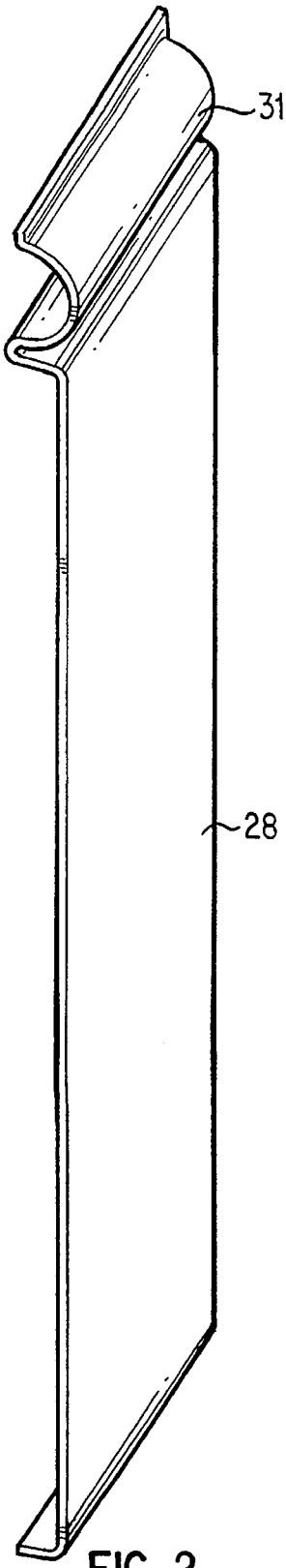
FIG. 2 is a perspective view of a modified lateral part.

The lateral part 28 of the embodiment according to FIG. 2 differs from lateral part 18 only as a result of the cross-sectional shape of the stamped profiling 31 which has a semi-cylindrical design. This profiling 31 also reaches on one side to the edge of the lateral part, whereas it is closed on the other side.

In the case of an embodiment which is modified with respect to FIGS. 1 and 2, it is provided that the stamping 21, 31 of the lateral parts 18, 28 is open toward the two edges of the lateral part 18, 28. In this case, the "stamped" profiling 21, 31 may also by achieved by a corresponding folding or tilting of the lateral part. This type of a profiling may receive connection pieces on both sides; that is, form connection openings for connection pieces. In this case, a partition is provided which divides the profiling in a transverse manner. This partition may also be constructed as an insert but also as a non-deformed area between the two stamped profilings. In addition, it is also possible to close one of the two openings by means of an inserted and soldered-in stopper. This construction has the advantage that identical lateral parts 18 or 28 may be used for both front ends of the heat exchanger, even if the feeding and draining pipe is to be connected on the same side.

Figure 3:
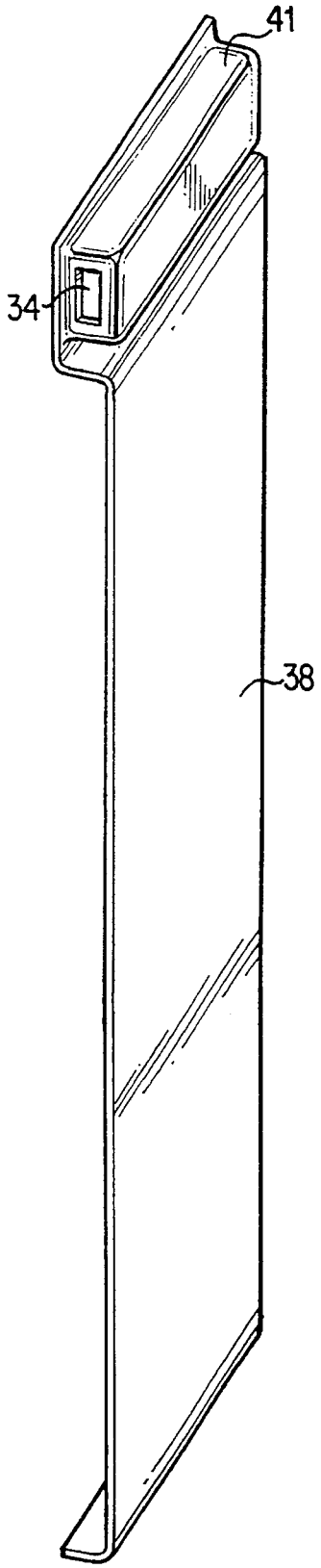
FIG. 3 is a perspective view of a lateral part with a bowl-shaped profiling which has a connection opening of a feeding or draining pipe.

In the case of the embodiment according to FIG. 3, the lateral part 38 is provided with a stamped, bowl-shaped profiling 41 which is surrounded by surrounding edges. In the case of this embodiment, a connection opening 34 for a connection piece of a feeding or draining pipe is provided in one or both of the two front walls of this stamped profiling. Since this connection opening 34 is formed exclusively by the profiling 41, its shape may be selected in a largely arbitrary manner without taking the closing sheet 17 into account.

Figure 4:
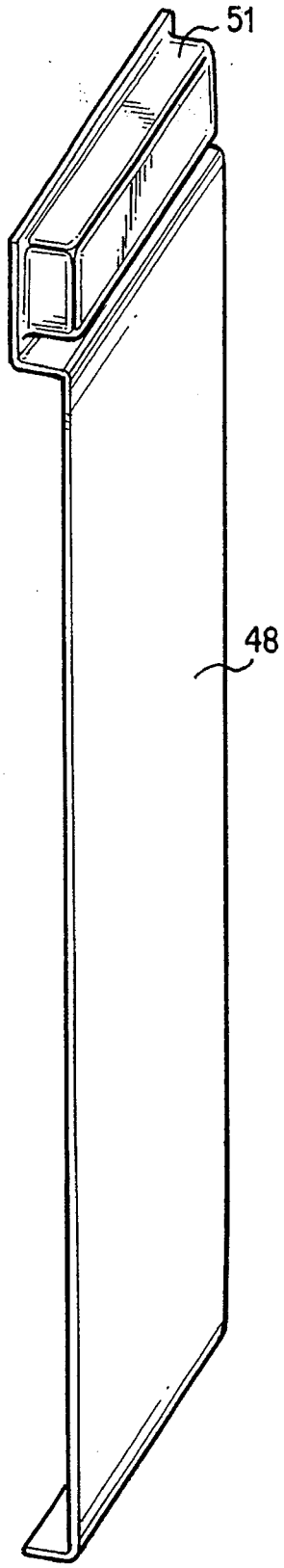
FIG. 4 is a perspective view of a lateral part with a closed profiling used as a deflection.

In the case of the embodiment according to FIG. 4, the lateral part is provided with a stamped profiling 51 which is closed on all sides and which, together with a covering sheet 17 which is not shown, forms a chamber which is closed toward the outside. If then openings are provided in the covering sheet which correspond to the collecting ducts, this profiling may be utilized as a deflection guide for the refrigerant.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A heat exchanger, particularly a refrigerant evaporator, comprising a soldered block of stamped plates having front ends, which stamped plates, in pairs, form a U-shaped guide and collecting ducts for a heat exchange medium, comprising corrugated ribs arranged between the plate pairs, and comprising plate-shaped lateral parts arranged on the front ends of the block and having further corrugated ribs arranged therebetween, wherein the lateral parts are provided in the area of the collecting ducts with at least one profiling, which forms a chamber with a covering sheet closing off an exterior one of said stamped plates, which chamber has a connection to at least one of the collecting ducts.

2. A heat exchanger according to claim 1, wherein the profiling is bowl-shaped.

3. A heat exchanger according to claim 2, wherein the profiling is provided at least on one side with a receiving opening for a connection piece.

4. A heat exchanger according to claim 1, wherein the profiling is constructed in a groove shape and, together with a closing sheet, forms at least on one front end a receiving opening for a connection piece.

5. A heat exchanger, comprising:

a soldered block of stamped plates which, in pairs, form collecting ducts for a heat exchange medium;

corrugated ribs arranged between the plate pairs;

a covering sheet for closing-off a last one of said stamped plates at each end of said soldered block; and an end plate arranged on each one of said covering sheets having further corrugated ribs arranged therebetween, at least one of said end plates having at least one profiled section formed only in an area of adjoining collecting ducts; and wherein said profiled section and said covering sheet form a chamber having a connection to at least one of the collecting ducts.

6. The heat exchanger according to claim 5, wherein said end plate is supported on a corresponding covering sheet only in an area of said profiled section and at a lower end.

7. A heat exchanger, particularly a refrigerant evaporator, comprising a soldered block of stamped plates having front ends, which stamped plates, in pairs, form a U-shaped guide and collecting ducts for a heat exchange medium, comprising corrugated ribs arranged between the plate pairs, and comprising plate-shaped lateral parts arranged on the front ends of the block and having further corrugated ribs arranged therebetween, wherein the lateral parts are provided with at least one profiling only in the area of the collecting ducts, which forms a chamber with a covering sheet closing off an exterior one of said stamped plates, which chamber has a connection to at least one of the collecting ducts.

* * * * *